US007493059B2

(12) United States Patent
Saitoh

(10) Patent No.: US 7,493,059 B2
(45) Date of Patent: Feb. 17, 2009

(54) METHOD AND APPARATUS FOR IMAGE FORMING WITH AN IMPROVED WARM-UP CONTROL

(75) Inventor: Seiji Saitoh, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 432 days.

(21) Appl. No.: 11/409,083

(22) Filed: Apr. 24, 2006

(65) Prior Publication Data

US 2006/0239707 A1 Oct. 26, 2006

(30) Foreign Application Priority Data

Apr. 22, 2005 (JP) ..... 2005-125279

(51) Int. Cl.
*G03G 15/20* (2006.01)

(52) U.S. Cl. ..... 399/70; 399/67; 399/69

(58) Field of Classification Search ..... 399/67, 399/69–70

See application file for complete search history.

(56) References Cited

U.S. PATENT DOCUMENTS

| | | | | |
|---|---|---|---|---|
| 5,722,012 | A | 2/1998 | Saitoh | |
| 6,104,889 | A | 8/2000 | Saitoh | |
| 6,816,701 | B2 | 11/2004 | Saitoh | |
| 7,212,761 | B2 * | 5/2007 | Sone et al. | 399/69 |
| 7,346,306 | B2 * | 3/2008 | Cho | 399/329 |
| 2004/0131375 | A1 * | 7/2004 | Lee | 399/70 |

FOREIGN PATENT DOCUMENTS

| | | |
|---|---|---|
| JP | 05-127565 | 5/1993 |
| JP | 08-227249 | 9/1996 |
| JP | 11-184360 | 7/1999 |

* cited by examiner

*Primary Examiner*—David M Gray
*Assistant Examiner*—Ryan D Walsh
(74) *Attorney, Agent, or Firm*—Oblon, Spivak, McClelland, Maier & Neustadt, P.C.

(57) ABSTRACT

An image forming apparatus includes an image forming mechanism, a fixing roller, a heater, a sensor, a warm-up mechanism, and a controller. The image forming mechanism forms a toner image on a recording medium according to image data. The fixing roller fixes the toner image on the recording medium by applying heat. The heater heats the fixing roller to warm up the fixing roller. The sensor detects a temperature of the fixing roller. The warm-up mechanism warms up the fixing roller by using the heater. The controller performs a first warm-up control that finishes the warm-up of the fixing roller and a second warm-up control that continues the warm-up of the fixing roller.

4 Claims, 5 Drawing Sheets

METHOD AND APPARATUS FOR IMAGE FORMING WITH AN IMPROVED WARM-UP CONTROL

CROSS-REFERENCE TO RELATED APPLICATION

The present application is based on and claims priority to Japanese patent application No. 2005-125279 filed on Apr. 22, 2005 in the Japan Patent Office, the entire contents of which are hereby incorporated herein by reference.

BACKGROUND OF THE INVENTION

1. Field of the Invention

The present invention relates to a method and an apparatus for image forming, and more particularly to a method and an apparatus for image forming with an improved warm-up control for fixing a toner image on a recording medium.

2. Description of the Background Art

A background electrophotographic image forming apparatus, such as a copying machine, a printer, or a facsimile machine, generally forms an electrostatic latent image on a photoconductor according to image data. The electrostatic latent image is visualized with toner to form a toner image on the photoconductor. The toner image is transferred onto a sheet and the sheet having the toner image is conveyed to a fixing unit in which heat and pressure fix the toner image on the sheet.

Such a background image forming apparatus is being required to save energy for environmental protection or compliance with various standards or regulations. To cope with such requirements, the fixing unit needs to be quickly heated to a predetermined temperature at which a proper fixing can be performed.

One example of such a background image forming apparatus includes a sensor for detecting a temperature of the fixing unit to attempt to shorten a warm-up time of the fixing unit. However, the sensor may detect the increasing temperature of the fixing unit with a delay while the fixing unit is warming up. Specifically, the temperature of the fixing unit detected by the sensor may be lower than an actual temperature of the fixing unit. Namely, even when the temperature of the fixing unit actually reaches the predetermined temperature at which a proper fixing can be performed, the image forming apparatus may judge that the temperature of the fixing unit has not reached the predetermined temperature based on the temperature detected by the sensor. As a result, the start of fixing operations of the image forming apparatus may be delayed.

In another example of such a background image forming apparatus, a time period required for the temperature of the fixing unit to reach the predetermined temperature is calculated in advance. When the calculated time period elapses, the image forming apparatus judges that the warm-up of the fixing unit is finished. However, the temperature of the fixing unit may not reach the predetermined temperature even when the calculated time period elapses when an input voltage of the fixing unit is not sufficiently high. As a result, a proper fixing cannot be performed.

SUMMARY OF THE INVENTION

This specification describes a novel image forming apparatus. In one aspect of the present invention, the novel image forming apparatus includes an image forming mechanism, a fixing roller, a heater, a sensor, a warm-up mechanism, and a controller. The image forming mechanism is configured to form a toner image on a recording medium according to image data. The fixing roller is configured to fix the toner image on the recording medium by applying heat. The heater is configured to heat the fixing roller to warm up the fixing roller. The sensor is configured to detect a temperature of the fixing roller. The warm-up mechanism is configured to warm up the fixing roller by using the heater. The controller is configured to perform a first warm-up control that finishes the warm-up of the fixing roller on either one of conditions that the temperature of the fixing roller detected by the sensor reaches a predetermined first temperature or that a predetermined time period elapses. The controller is also configured to perform a second warm-up control that continues the warm-up of the fixing roller until the temperature of the fixing roller detected by the sensor reaches a predetermined third temperature, which is not lower than the predetermined first temperature, when the temperature of the fixing roller detected by the sensor does not reach a predetermined second temperature, which is not higher than the predetermined first temperature, even when the predetermined time period elapses.

This specification further describes a novel image forming method. In one aspect of the present invention, the novel image forming method includes forming a toner image on a recording medium according to image data, warming up a fixing roller by heating the fixing roller with a heater, performing a first warm-up control that finishes the warm-up of the fixing roller on either one of conditions that a temperature of the fixing roller detected by a sensor reaches a predetermined first temperature or that a predetermined time period elapses, performing a second warm-up control that continues the warm-up of the fixing roller until the temperature of the fixing roller detected by the sensor reaches a predetermined third temperature, which is not lower than the predetermined first temperature, when the temperature of the fixing roller detected by the sensor does not reach a predetermined second temperature, which is not higher than the predetermined first temperature, even when the predetermined time period elapses, and fixing the toner image on the recording medium by applying heat of the fixing roller.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
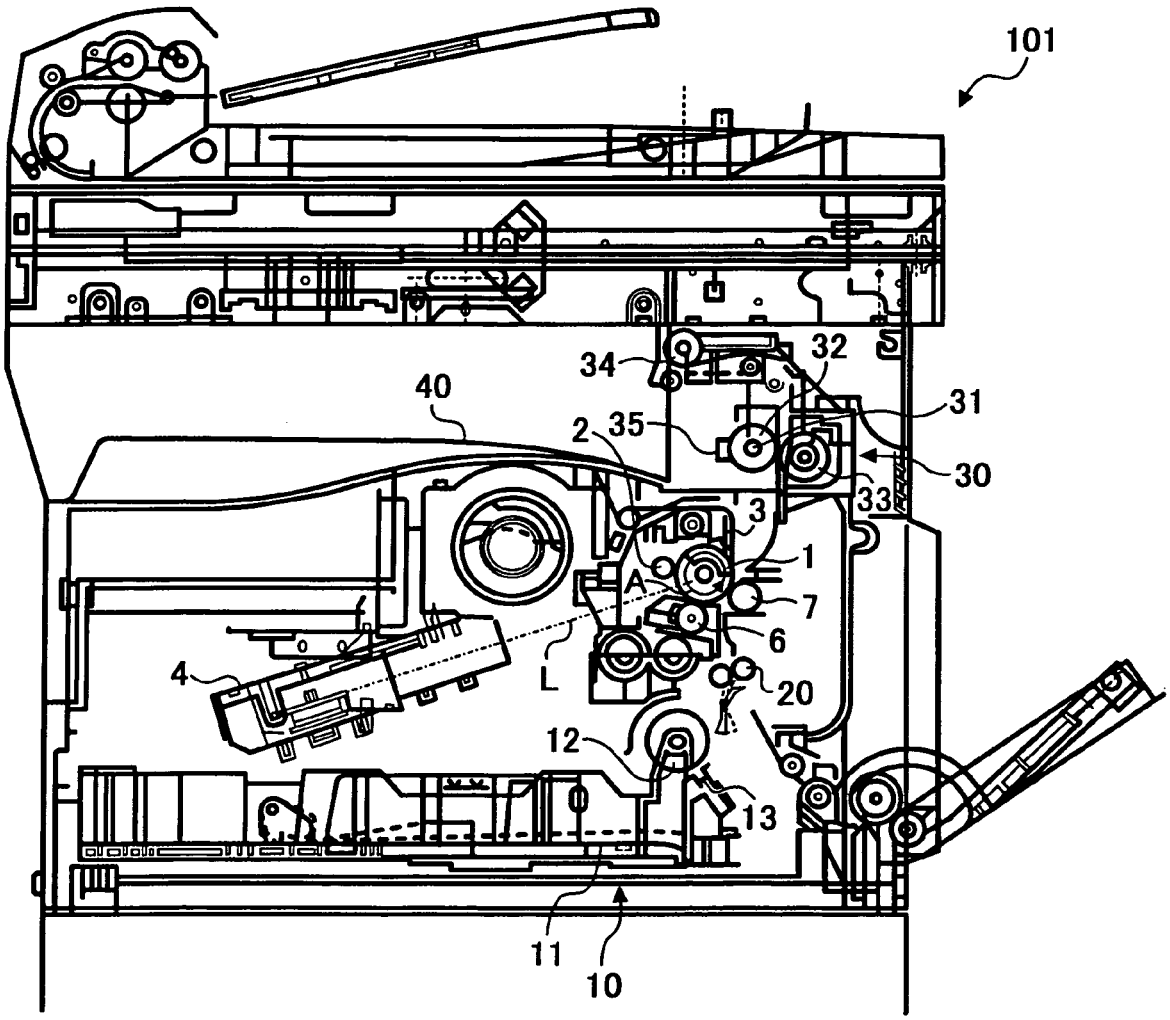
FIG. 1 is a schematic view of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, and particularly to FIG. 1, an image forming apparatus 101 according to an exemplary embodiment of the present invention is explained.

As illustrated in FIG. 1, the image forming apparatus 101 includes a photoconductor 1, a charger 2, an exposure unit 4, a development unit 6, a paper tray 10 including a bottom plate 11, a feeding roller 12, a separating pad 13, a registration roller pair 20, a transferor 7, a cleaning unit 3, a fixing unit 30 (including a heater 31, a fixing roller 32, a sensor 35, and a pressure roller 33), an ejecting roller 34, and an output tray 40.

The image forming apparatus 101 forms an image in an electrophotographic method. According to this non-limiting embodiment, the image forming apparatus 101 functions as a digital copying machine. The photoconductor 1 rotates in a rotating direction A. The charger 2, the exposure unit 4, the development unit 6, the transferor 7, and the cleaning unit 3 are disposed around the photoconductor 1. The charger 2 uniformly charges a surface of the photoconductor 1. The exposure unit 4 irradiates light L onto the surface of the photoconductor 1 to form an electrostatic latent image according to image data. The development unit 6 visualizes the electrostatic latent image formed on the surface of the photoconductor 1 with toner to form a toner image.

A recording medium is placed on the bottom plate 11 of the paper tray 10. The recording medium includes sheets and OHP (overhead projector) transparencies and is hereinafter referred to as "the sheet". The paper tray 10 is disposed in a lower portion of the image forming apparatus 101 and is attachable to and detachable from the lower portion. The bottom plate 11 moves upward to cause an uppermost sheet of the sheets placed on the bottom plate 11 to pressingly contact the feeding roller 12. The feeding roller 12 rotates to feed the sheets placed on the bottom plate 11 toward the registration roller 20. While the feeding roller 12 rotates, the separating pad 13 separates the uppermost sheet from the other sheets. The registration roller pair 20 feeds the uppermost sheet toward the transferor 7 at a timing when the toner image formed on the surface of the photoconductor 1 is properly transferred onto the sheet. The transferor 7 transfers the toner image formed on the surface of the photoconductor 1 onto the fed sheet. The cleaning unit 3 removes residual toner not transferred and remaining on the surface of the photoconductor 1. The sheet having the toner image transferred thereto is further fed toward the fixing unit 30.

In the fixing unit 30, the pressure roller 33 faces the fixing roller 32 including the heater 31 to apply pressure to the fixing roller 32. The heater 31 heats the fixing roller 32. The sensor 35 detects a temperature of the fixing roller 32. While the sheet is conveyed through a nip formed between the fixing roller 32 and the pressure roller 33, heat applied by the fixing roller 32 and pressure applied by the pressure roller 33 fix the toner image on the sheet. The ejecting roller 34 feeds the sheet having the fixed toner image onto the output tray 40 with the fixed toner image facing down.

Figure 2:
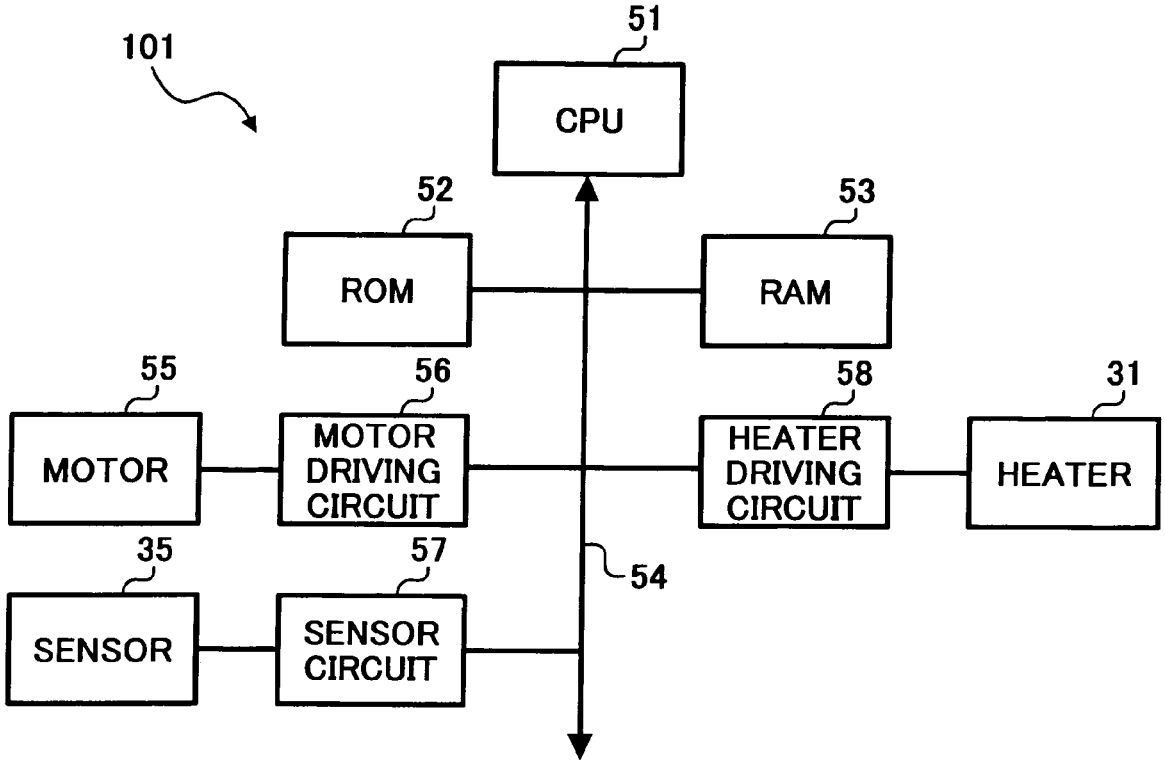
FIG. 2 is a block diagram of an electrical structure of the image forming apparatus shown in FIG. 1.

As illustrated in FIG. 2, the image forming apparatus 101 further includes a CPU (central processing unit) 51, a ROM (read-only memory) 52, a RAM (random-access memory) 53, a bus 54, a motor 55, a motor driving circuit 56, a sensor circuit 57 connected to the temperature sensor 35, and a heater driving circuit 58 connected to the heater 31.

The CPU 51 controls operations of the image forming apparatus 101. The ROM 52 stores various programs executed by the CPU 51 and fixed data. The RAM 53 provides an operation area for the CPU 51. The motor driving circuit 56 drives the motor 55. The motor 55 drives the fixing roller 32. The sensor circuit 57 drives the sensor 35. The heater driving circuit 58 drives the heater 31.

The CPU 51, the ROM 52, and the RAM 53 are connected to the bus 54. The motor 55, the sensor 35, and the heater 31 are connected to the bus 54 via the motor driving circuit 56, the sensor circuit 57, and the heater driving circuit 58 respectively. Further, various other sensors and actuators (not shown) are connected to the bus 54.

The CPU 51 turns on and off the heater 31 based on the temperature of the fixing roller 32 detected by the sensor 35 to maintain the temperature of the fixing roller 32 within a desired temperature range.

The image forming apparatus 101 is configured to shorten a warm-up time of the fixing unit 30. To achieve that benefit the temperature of the fixing roller 32 is increased at a high speed. However, in that circumstance the sensor 35 may detect with a delay that the temperature of the fixing roller 32 reaches a desired fixing temperature. When the sensor 35 is strained due to continuous use of the image forming apparatus 101, the sensor 35 may detect a temperature with even more of a delay.

Figure 3:
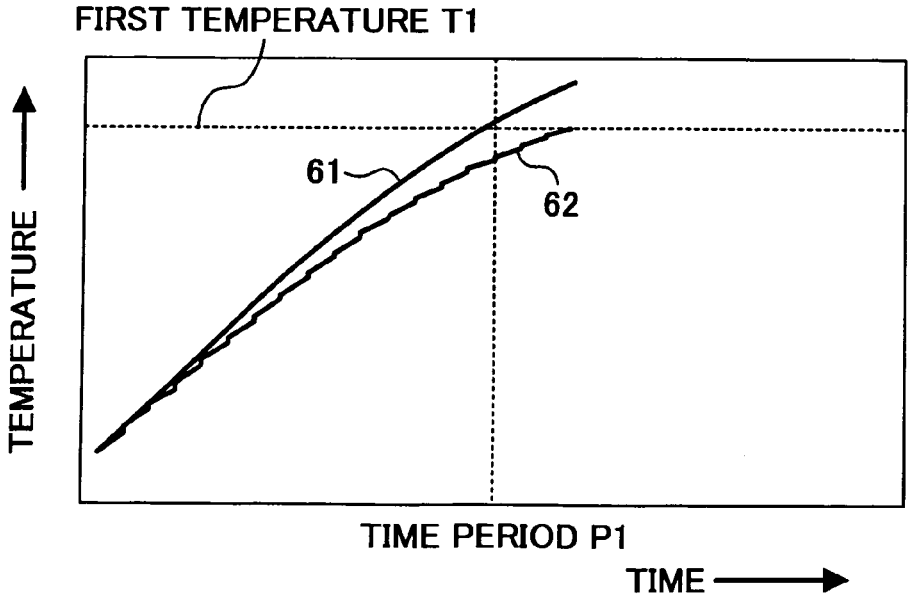
FIG. 3 is a graph illustrating temperature increase of a fixing roller of the image forming apparatus shown in FIG. 1.

Referring to FIG. 3, the following describes the delay in temperature detection. FIG. 3 is a graph illustrating the temperature of the fixing roller 32 changing with time. A curve 61 represents an actual temperature of the fixing roller 32 and a curve 62 represents a temperature of the fixing roller 32 detected by the sensor 35. The actual temperature of the fixing roller 32 reaches a predetermined first temperature T1 within a predetermined time period P1. However, the temperature of the fixing roller 32 detected by the sensor 35 does not reach the first temperature T1 when the time period P1 elapses. Thus, the CPU 51 may judge that the actual temperature of the fixing roller 32 does not reach the first temperature T1 even when the time period P1 (i.e., the warm-up time) elapses.

In the above-described configuration of the image forming apparatus 101, the image forming apparatus 101 may not provide the standardized warm-up time if the heater 31 is turned off at time period P1. An output of the heater 31 and a thickness of the fixing roller 32 are generally set to or near limit values in terms of an amount of heat. Therefore, it may be difficult to set the output of the heater 31 and the thickness of the fixing roller 32 by considering the delay in detection by the sensor 35.

To cope with such a condition, the CPU 51 may be configured to judge that the warm-up of the fixing roller 32 is finished when the time period P1 elapses based on a prediction that the actual temperature of the fixing roller 32 reaches the first temperature T1 within the time period P1, regardless of the delay in detection by the sensor 35.

Figure 4:
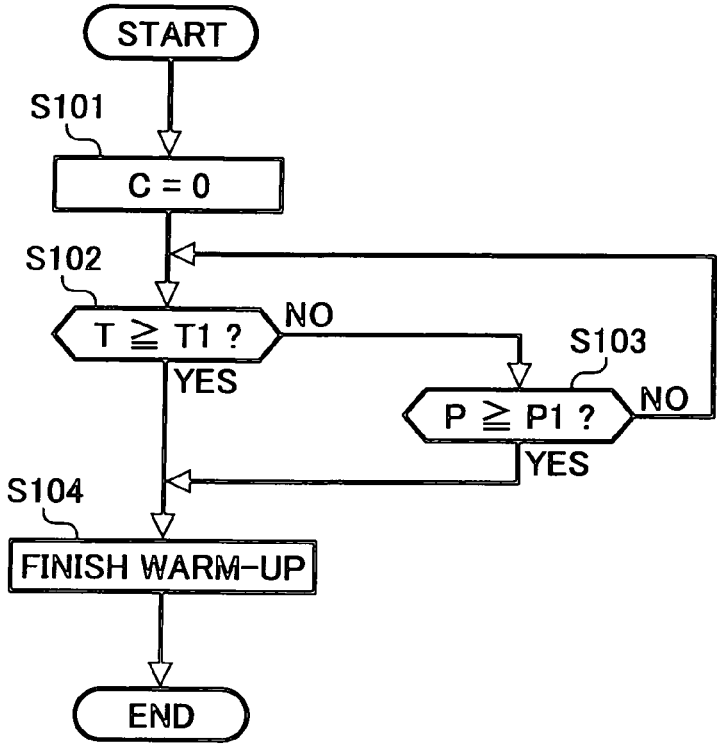
FIG. 4 is a flowchart illustrating operations of a CPU (central processing unit) of the electrical structure shown in FIG. 2.

FIG. 4 is a flowchart illustrating operations of the CPU 51 configured as described above. In step S101, a counter starts counting after a count C of the counter is reset to "0". In step S102, the CPU 51 monitors whether a temperature T of the fixing roller 32 reaches the first temperature T1 or not. If the temperature T of the fixing roller 32 reaches the first temperature T1 (i.e., if YES in step S102), the CPU 51 judges that the warm-up of the fixing roller 32 is finished in step S104. If the temperature T of the fixing roller 32 does not reach the first temperature T1 (i.e., if NO in step S102), the CPU 51 monitors whether the time period P1 elapses or not in step S103. If the time period P1 elapses (i.e., if YES in step S103), the CPU 51 judges that the warm-up of the fixing roller 32 is finished in step S104.

Factors affecting the increase in the temperature of the fixing roller 32 may include the output of the heater 31 and the thickness of the fixing roller 32. Factors affecting the increase in the temperature of the fixing unit 30 may include conditions of the fixing unit 30. Therefore, the time period P1 may be set by considering the worst imaginable conditions caused by those factors. However, the worst imaginable conditions may not be properly determined due to other factors including an output voltage and an environment where the image forming apparatus 101 is located. In this case, the actual temperature of the fixing roller 32 may not reach the first temperature T1 even when the time period P1 elapses. Thus, fixing may not be properly performed when the sheet is fed into the fixing unit 30 immediately after the time period P1 elapses.

Figure 5:
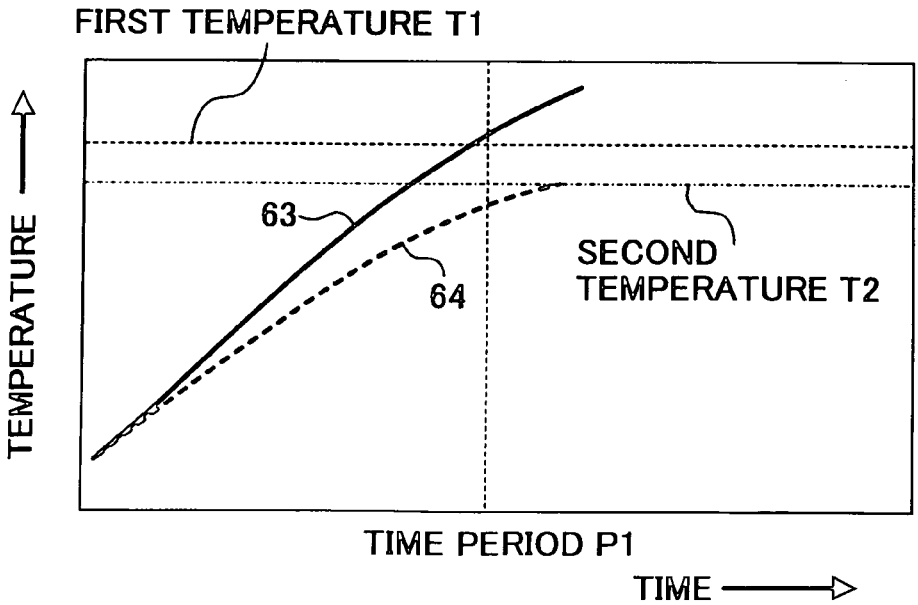
FIG. 5 is a graph illustrating another temperature increase of the fixing roller of the image forming apparatus shown in FIG. 1.

FIG. 5 is a graph illustrating the increase in the temperature of the fixing roller 32 in other circumstances. A curve 63 represents the temperature of the fixing roller 32 when a rated voltage is applied. A curve 64 represents the temperature of the fixing roller 32 when a lower voltage is applied.

The image forming apparatus 101 includes the sensor 35. Therefore, the CPU 51 may control the operations of the image forming apparatus 101 in accordance with conditions (e.g., temperature) of the environment where the image forming apparatus 101 is located. For example, if the image forming apparatus 101 is powered on when the sensor 35 detects the temperature of the fixing roller 32 is below an allowable limit, the warm-up will not be finished even when the time period P1 elapses. Therefore, an additional sensor, such as a voltage sensor, may be required, resulting in an increase in manufacturing costs and layout modification of the image forming apparatus 101. Particularly, it may be difficult to provide the additional sensor in the compact, low-cost image forming apparatus 101.

The following describes operations for controlling a fixing temperature of the fixing unit 30, particularly when the fixing unit 30 is turned on, so as to solve the above-described problems without increasing manufacturing costs caused by needing the additional voltage sensor.

Figure 6:
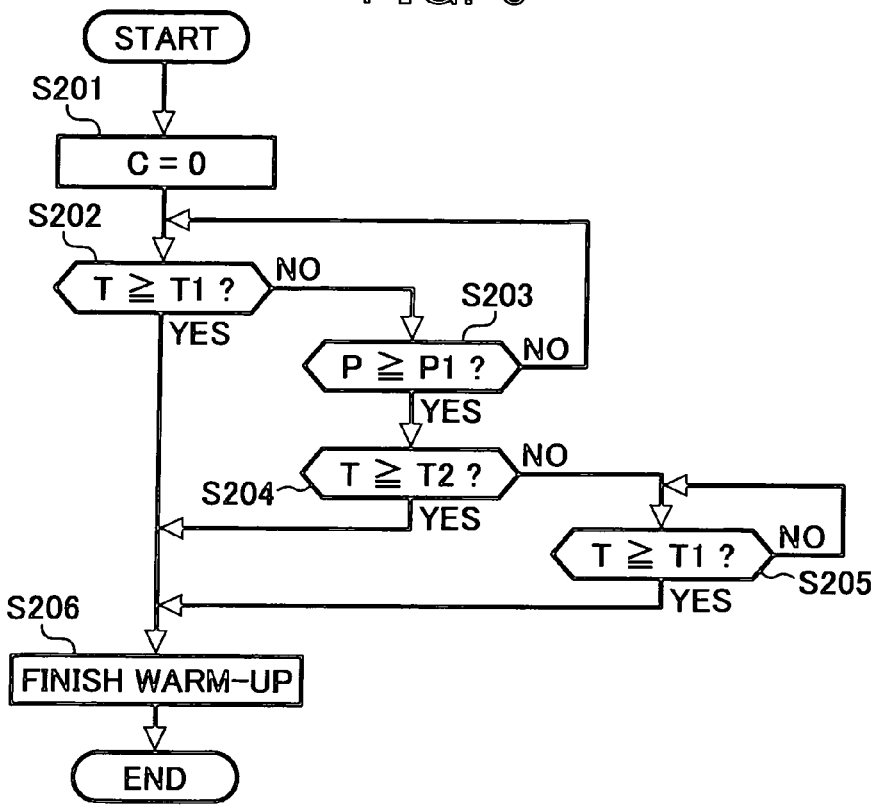
FIG. 6 is a flowchart illustrating operations of the CPU of the electrical structure shown in FIG. 2 according to an exemplary embodiment of the present invention.

FIG. 6 is a flowchart illustrating operations for controlling the fixing temperature of the fixing unit 30 according to an exemplary embodiment of the present invention. The operations illustrated in FIG. 6 may be performed when the fixing temperature detected when the time period P1 elapses is low enough to be below an allowable limit of error and a faulty image may be produced if the sheet is fed into the fixing unit 30 at that too low fixing temperature.

In step S201, the counter starts counting after the count C of the counter is reset to "0". In step S202, the CPU 51 monitors whether the temperature T of the fixing roller 32 reaches the first temperature T1 or not. If the temperature T of the fixing roller 32 reaches the first temperature T1 (i.e., if YES in step S202), the CPU 51 judges that the warm-up of the fixing roller 32 is finished in step S206. If the temperature T of the fixing roller 32 does not reach the first temperature T1 (i.e., if NO in step S202), the CPU 51 monitors whether the time period P1 elapses or not in step S203. If the time period P1 elapses (i.e., if YES in step S203), the CPU 51 monitors whether the temperature T of the fixing roller 32 reaches a predetermined second temperature T2, which is not higher than the first temperature T1, or not in step S204. If the temperature T of the fixing roller 32 reaches the second temperature T2 (i.e., if YES in step S204), the CPU 51 judges that the warm-up of the fixing roller 32 is finished in step S206. The second temperature T2 is determined based on whether a faulty image may be produced or not if the sheet is fed into the fixing unit 30 when at that second temperature T2 and whether the CPU 51 may judge that the input voltage of the heater 31 is substantially low or not. If the temperature T of the fixing roller 32 does not reach the second temperature T2 (i.e., if NO in step S204), the CPU 51 monitors whether the temperature T of the fixing roller 32 reaches the first temperature T1 or not in step S205. When the temperature T of the fixing roller 32 reaches the first temperature T1 (i.e., when YES in step S205), the CPU 51 judges that the warm-up of the fixing roller 32 is finished in step S206.

The above-noted operation as discussed with respect to FIG. 6 may be particularly beneficial in a case in which an environmental temperature or an insufficient input voltage prevents the fixing roller 32 from increasing to an appropriate temperature by the time P1. More particularly, in the operation shown in FIG. 6 if the temperature of the fixing roller 32 does not reach the second temperature T2 at the time P1 in step S204, that may indicate that an environmental temperature or an insufficient input voltage is preventing the increase in temperature of the fixing roller 32 and it may therefore take a longer time before the temperature of the fixing roller 32 reaches an appropriate temperature for fixing (i.e., the first temperature T1). Therefore, in the operation in FIG. 6 in such situations the warm-up continues until the temperature of the fixing roller 32 reaches the first temperature T1, i.e., until YES in step S205.

Figure 7:
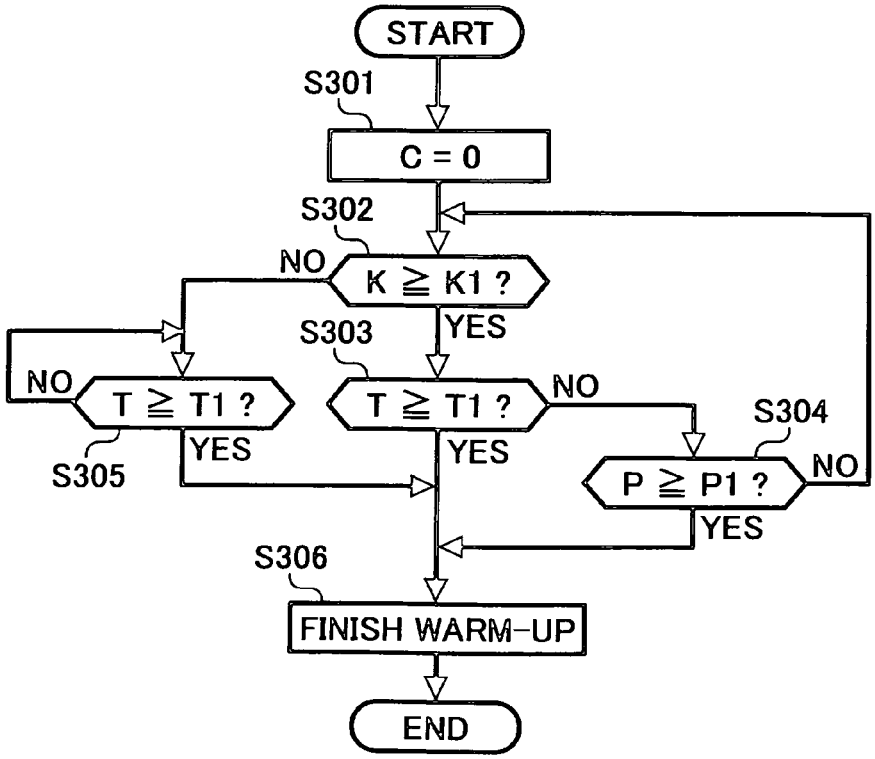
FIG. 7 is a flowchart illustrating operations of the CPU of the electrical structure shown in FIG. 2 according to another exemplary embodiment of the present invention.

FIG. 7 is a flowchart illustrating the operations for controlling the fixing temperature of the fixing unit 30 by using a temperature gradient according to another exemplary embodiment of the present invention. The CPU 51 periodically monitors a temperature gradient K of the temperature of the fixing roller 32 detected by the sensor 35 during the warm-up of the fixing roller 32. The temperature gradient K is compared with a gradient K1. The gradient K1 is determined based on whether a faulty image may be produced or not if the sheet is fed into the fixing unit 30 when at that gradient K1 and whether the CPU 51 may judge that the input voltage of the heater 31 is substantially low or not.

In step S301, the counter starts counting after the count C of the counter is reset to "0". In step S302, the CPU 51 monitors whether the temperature gradient K reaches the gradient K1 or not. If the temperature gradient K reaches the gradient K1 (i.e., if YES in step S302), the CPU 51 monitors whether the temperature T of the fixing roller 32 reaches the first temperature T1 or not while continuously monitoring the temperature gradient K in step S303. If the temperature T of the fixing roller 32 does not reach the first temperature T1 (i.e., if NO in S303), the CPU 51 monitors whether the time period P1 elapses or not while continuously monitoring the temperature gradient K in step S304. If the temperature T of the fixing roller 32 reaches the first temperature T1 (i.e., if YES in step S303) or if the time period P1 elapses (i.e., if YES in step S304), the CPU 51 judges that the warm-up of the fixing roller 32 is finished in step S306. If the temperature gradient K does not reach the gradient K1 (i.e., if NO in step S302), the CPU 51 monitors whether the temperature T of the fixing roller 32 reaches the first temperature T1 or not in step S305, without monitoring whether the time period P1 elapses or not. When the temperature T of the fixing roller 32 reaches the first temperature T1 (i.e., when YES in step S305), the CPU 51 judges that the warm-up of the fixing roller 32 is finished in step S306.

The temperature of the fixing roller 32 at which the CPU 51 judges that the warm-up of the fixing roller 32 is finished is usually preset lower than the temperature at which fixing can be performed, because the temperature of the fixing roller 32 may further increase while the sheet fed after the CPU 51 judges that the warm-up of the fixing roller 32 is finished is conveyed to the fixing unit 30. This shortens the warm-up time.

When the input voltage of the heater 31 is not sufficient, it may take longer for the temperature of the fixing roller 32 to reach the temperature at which the CPU 51 judges that the warm-up of the fixing roller 32 is finished. The temperature of the fixing roller 32 may also not sufficiently increase while the sheet fed after the CPU 51 judges that the warm-up of the fixing roller 32 is finished is conveyed to the fixing unit 30. Thus, the temperature of the fixing roller 32 may not reach the preset temperature when the sheet is fed into the fixing unit 30.

Figure 8:
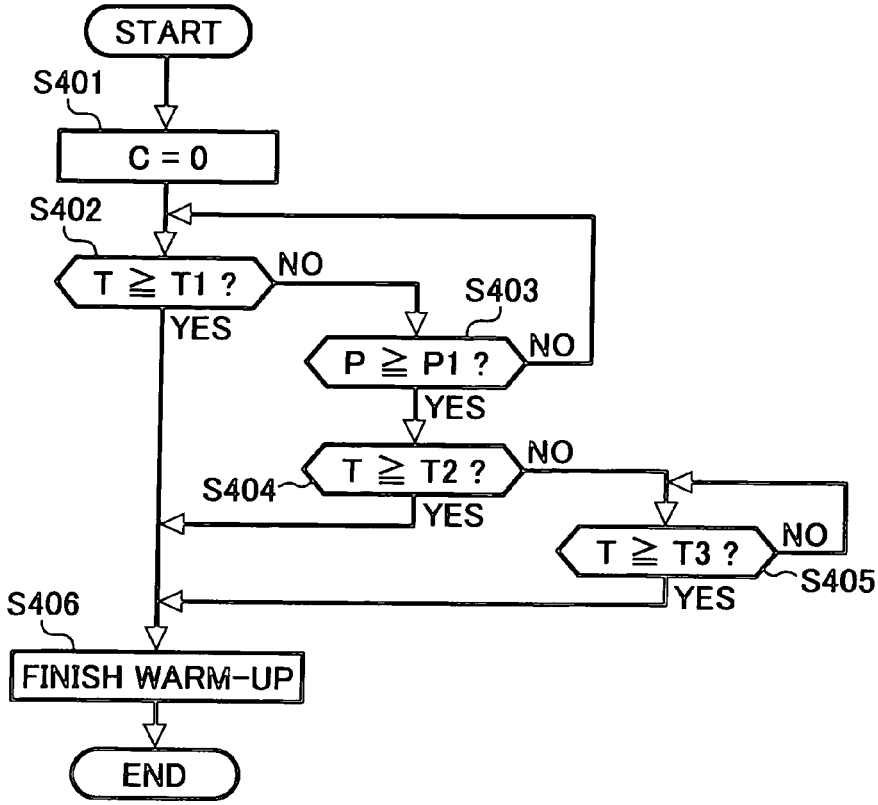
FIG. 8 is a flowchart illustrating operations of the CPU of the electrical structure shown in FIG. 2 according to yet another exemplary embodiment of the present invention.
Figure 9:
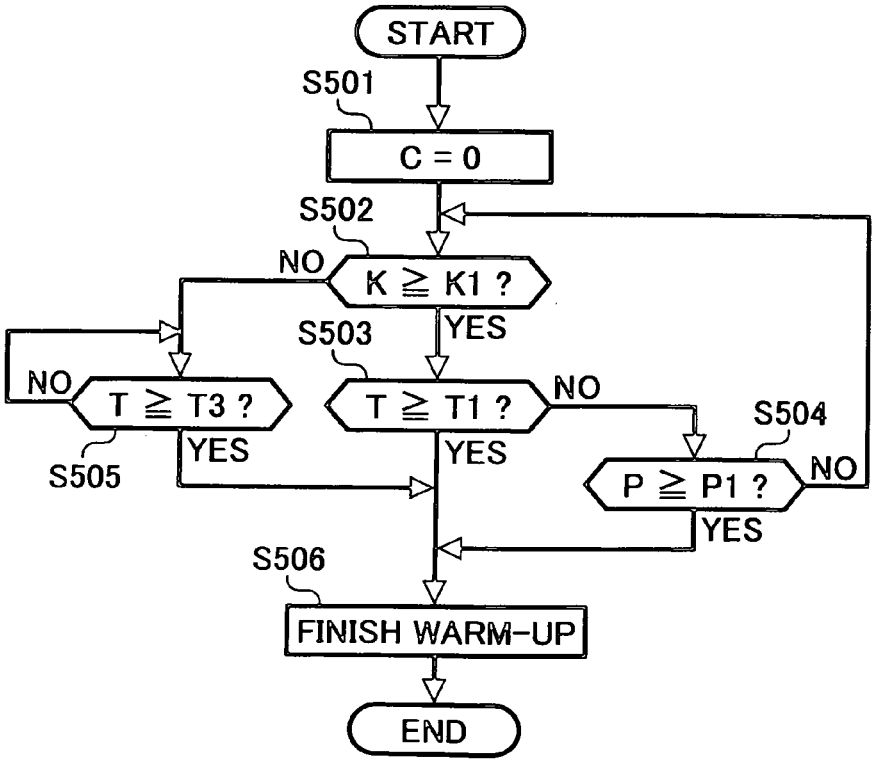
FIG. 9 is a flowchart illustrating operations of the CPU of the electrical structure shown in FIG. 2 according to yet another exemplary embodiment of the present invention.

FIGS. 8 and 9 are flowcharts illustrating operations of further exemplary embodiments of the present invention that solve the above-described problems. In FIG. 8, steps S401, S402, S403, S404, and S406 respectively replace S201, S202, S203, S204, and S206. However, S205 is replaced by S405 in which a predetermined third temperature T3 is preset instead of the first temperature T1. The third temperature T3 is not lower than the first temperature T1. In FIG. 9, steps S501, S502, S503, S504, and S506 respectively replace S301, S302, S303, S304, and S306. However, S305 is replaced by S505 in which the third temperature T3 is preset instead of the first temperature T1.

In the operations in FIGS. 8 and 9 the third temperature T3 is used for an image forming apparatus which, for example, is located in a low-temperature environment in which the temperature of the fixing roller 32 may decrease when plural sheets are continuously fed to the fixing roller 32 after the warm-up is finished. The first temperature T1 can then be used for an image forming apparatus that is not located in such a low-temperature environment. That is, in the operation in FIGS. 8 and 9 when the temperature T2 is not reached at the time P1, i.e., when NO at step S404, the third temperature T3 is then used.

As illustrated in FIG. 8, when the temperature of the fixing roller 32 detected by the sensor 35 after the time period P1 elapses (i.e., if YES in step S403) does not reach the second temperature T2 (i.e., if YES in step S404), the warm-up of the fixing roller 32 continues until the temperature of the fixing roller 32 reaches the third temperature T3 (i.e., until YES in step S405). As illustrated in FIG. 9, the temperature gradient K is calculated until the time period P1 elapses. When the calculated temperature gradient K does not reach the gradient K1 (i.e., if NO in step S502), the warm-up of the fixing roller 32 continues until the temperature of the fixing roller 32 reaches the third temperature T3 (i.e., until YES in step S505). The third temperature T3, which is not lower than the first temperature Ti, may be used instead of the first temperature T1 by the CPU 51 to judge that the warm-up of the fixing roller 32 is finished.

Thus, even if the temperature of the fixing roller 32 does not reach the desired temperature due to an insufficient input voltage of the heater 31 when the sheet is fed onto the fixing roller 32, the image forming apparatus 101 may provide the shortened warm-up time while providing improved image quality producing no faulty image caused by improper fixing without an increase in manufacturing costs.

The above-described operations may be effective when the sheet is fed onto the fixing roller 32 immediately after the CPU 51 judges that the warm-up of the fixing roller 32 is finished in step S406 or S506. When no sheet is fed onto the fixing roller 32 immediately after the CPU 51 judges that the warm-up of the fixing roller 32 is finished, fixing may be properly performed if the CPU 51 judges that the warm-up of the fixing roller 32 is finished when the time period P1 elapses, even if the temperature of the fixing roller 32 does not reach the first temperature T1, the second temperature T2, or the third temperature T3. The operations illustrated in FIGS. 6 to 9 may be performed only when a sheet feeding signal for feeding the sheet onto the fixing roller 32 is output while the fixing roller 32 is warmed up.

Thus, the image forming apparatus 101 may provide the shortened warm-up time while providing improved image quality producing no faulty image caused by improper fixing without an increase in manufacturing costs.

The sheet feeding signal may not be output while the fixing roller 32 is warmed up, but output immediately after the CPU 51 judges that the warm-up of the fixing roller 32 is finished when the time period P1 elapses while the temperature of the fixing roller 32 does not reach the first temperature T1. In this case, the temperature of the fixing roller 32 may not sufficiently increase, resulting in improper fixing.

To solve this problem, the CPU 51 may judge whether the temperature of the fixing roller 32 reaches the first temperature T1 or the third temperature T3 simultaneously with the sheet feeding signal output after the warm-up of the fixing roller 32 is finished. When the temperature of the fixing roller 32 does not reach the first temperature T1 or the third temperature T3 but reaches the second temperature T2, feeding the sheet onto the fixing roller 32 may start after the temperature of the fixing roller 32 reaches the first temperature T1 or the third temperature T3.

Thus, the image forming apparatus 101 may provide the shortened warm-up time while providing improved image quality producing no faulty image caused by improper fixing without the increase in manufacturing costs.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

The invention claimed is:

1. An image forming apparatus, comprising:

an image forming mechanism configured to form a toner image on a recording medium according to image data;

a fixing roller configured to fix the toner image on the recording medium by applying heat;

a heater configured to heat the fixing roller to warm up the fixing roller;

a sensor configured to detect a temperature of the fixing roller;

a warm-up mechanism configured to warm up the fixing roller by using the heater;

a controller configured to perform a first warm-up control that finishes the warm-up of the fixing roller on either one of conditions that the temperature of the fixing roller detected by the sensor reaches a predetermined first temperature or that a predetermined time period elapses; and the controller configured to perform a second warm-up control that continues the warm-up of the fixing roller until the temperature of the fixing roller detected by the sensor reaches a predetermined third temperature, which is not lower than the predetermined first temperature, when the temperature of the fixing roller detected by the sensor does not reach a predetermined second temperature, which is not higher than the predetermined first temperature, even when the predetermined time period elapses.

2. The image forming apparatus according to claim 1, wherein the controller performs a third warm-up control that carries out the second warm-up control on a condition that a signal for feeding the recording medium onto the fixing roller is output while the fixing roller is warmed up.

3. The image forming apparatus according to claim 1, wherein the controller starts feeding the recording sheet onto the fixing roller after the temperature of the fixing roller detected by the sensor reaches one of the predetermined first temperature or the predetermined third temperature when a signal for feeding the recording medium onto the fixing roller is output after the warm-up of the fixing roller is finished.

4. An image forming method, comprising:

forming a toner image on a recording medium according to image data;

warming up a fixing roller by heating the fixing roller with a heater;

performing a first warm-up control that finishes the warm-up of the fixing roller on either one of conditions that a temperature of the fixing roller detected by a sensor reaches a predetermined first temperature or that a predetermined time period elapses;

performing a second warm-up control that continues the warm-up of the fixing roller until the temperature of the fixing roller detected by the sensor reaches a predetermined third temperature, which is not lower than the predetermined first temperature, when the temperature of the fixing roller detected by the sensor does not reach a predetermined second temperature, which is not higher than the predetermined first temperature, even when the predetermined time period elapses; and fixing the toner image on the recording medium by applying heat of the fixing roller.

* * * * *